US005635113A

United States Patent [19]

Walsh et al.

[11] Patent Number: 5,635,113

[45] Date of Patent: Jun. 3, 1997

[54] CARBURETOR ADJUSTMENT SCREW APPARATUS

[75] Inventors: Patrick Walsh; Roger Bowles, both of Tralee, Ireland

[73] Assignee: Barcarole Limited, Cork, Ireland

[21] Appl. No.: 542,774

[22] Filed: Oct. 13, 1995

[30] Foreign Application Priority Data

Feb. 17, 1995 [IE] Ireland ..... S950133

[51] Int. Cl.[6] ..... F02M 3/08

[52] U.S. Cl. ..... 261/71; 261/DIG. 38; 261/DIG. 84; 137/382

[58] Field of Search ..... 261/71, DIG. 84, 261/DIG. 38; 137/382

[56] References Cited

U.S. PATENT DOCUMENTS

| | | | |
|---|---|---|---|
| 2,618,473 | 11/1952 | Whitford | 261/DIG. 84 |
| 3,618,906 | 11/1971 | Charron | 137/382.5 |
| 4,097,561 | 6/1978 | Seki et al. | 261/DIG. 38 |
| 4,246,929 | 1/1981 | Wakeman | 137/382 |
| 4,271,095 | 6/1981 | Maeda | 137/382 |
| 4,378,321 | 3/1983 | Miller | 137/382 |
| 5,055,238 | 10/1991 | Araki | 261/DIG. 38 |
| 5,236,634 | 8/1993 | Hammett et al. | 261/DIG. 84 |
| 5,252,261 | 10/1993 | Gerhardy | 261/DIG. 84 |
| 5,322,645 | 6/1994 | Hammett et al. | 261/DIG. 84 |

FOREIGN PATENT DOCUMENTS

| | | | |
|---|---|---|---|
| 2401803 | 9/1974 | Germany | 261/DIG. 84 |
| 2548226 | 5/1976 | Germany | 261/DIG. 84 |
| 2855172 | 8/1979 | Germany | 261/DIG. 38 |
| 0014234 | 2/1978 | Japan | 261/DIG. 84 |

*Primary Examiner*—Tim R. Miles

*Attorney, Agent, or Firm*—Harness, Dickey & Pierce, P.L.C.

[57] ABSTRACT

A fuel adjustment screw apparatus for a diaphragm-type carburetor comprises a screw member (4) having a shaft (4a) and a head (12) by which the shaft may be rotated, with a generally tubular open-ended housing (9) surrounding the head of the screw member. A cap member (10) is mounted in the housing and is movable axially of the screw member between a first position (as seen in FIG. 1) and a second position (FIG. 2). The cap member is held clear of the head of the screw member in the first position so that the screw member can rotate freely, and engages over the head of the screw member in the second position for rotation with the head. The housing has stop means (20) which is engaged by the cap member in the second position for limiting the angle of rotation of the head.

6 Claims, 7 Drawing Sheets

CARBURETOR ADJUSTMENT SCREW APPARATUS

FIELD OF THE INVENTION

The present invention relates to an adjustment screw apparatus for adjusting fuel flow in a carburetor, for example a diaphragm-type carburetor.

BACKGROUND TO THE INVENTION

A diaphragm-type carburetor comprises a main body portion defining a carburetor mixing passage having an air intake side and an engine outlet side, fuel pump means, a throttle shutter mounted within the carburetor mixing passage between the air intake side and the engine outlet side, a throttle shaft for controlling the throttle shutter, and a metering chamber for supplying fuel from the fuel pump means into the carburetor mixing passage via a high speed adjusting screw and a low speed/idle adjusting screw.

In such a carburetor the volume of fuel delivered to the engine is adjustable, for low speed operation via the low speed/idle adjusting screw and for high speed operation via the high speed adjusting screw. Adjustment is factory set by the engine manufacturer to give the desired engine performance/air fuel ratios.

With such a system, adjustment can be made within a broad band from no fuel flow, when the adjustment needle is screwed fully in (i.e. the needle tip closes the orifice) to fully open, when the needle tip is fully out of the orifice. In this case the orifice diameter controls the maximum volume of fuel flow. This system allows the engine to be set to run on a very lean or very rich fuel mixture. More often the correct factory setting is re-adjusted by the end user. Such lean and rich conditions result in undesirable exhaust emissions.

With the advent of emission regulations applicable to IC engines and in particular to two-stroke engines which are regulated by the type of carburetor mentioned above, it is necessary to have a system which limits the amount of adjustment on the low speed and high speed screw adjustment screws. It should also be possible for such a system to be adjusted and set after the carburetor has been assembled to a complete engine or a suitable end product such as typically, a chainsaw.

In particular with IC engine powered garden equipment, chainsaws etc., it is necessary for the manufacturer of the end product to final adjust set and certify air/fuel ratios to comply with emission regulations on each fully assembled unit prior to packing/shipping. This requires single point adjustment of the low and high speed screws, i.e. tuning each carburetor to each individual engine requirements prior to fixing the limits. It is not possible to achieve this with the above mentioned system.

It is an object of the present invention to overcome these problems by providing a device which will allow for optimum single point setting of both high and low adjust screws on a finished product such as a chainsaw or disc cutter prior to fixing the limited adjustment cap on the high speed and low speed screws.

SUMMARY OF THE INVENTION

The invention provides a carburetor adjustment screw apparatus comprising a screw member having a shaft and a head by which the shaft may be rotated, a generally tubular open-ended housing surrounding the head of the screw member, and a cap member mounted in the open end of the housing and movable axially of the screw member between first and second positions, the cap member being held clear of the head of the screw member in the first position and engaging over the head of the screw member in the second position for rotation with the head, the housing having stop means engageable by the cap member in the second position for limiting the angle of rotation of the head.

BRIEF DESCRIPTION OF THE DRAWINGS

The invention will be understood in greater detail from the following description of preferred embodiments thereof given by way of example only and with reference to the accompanying drawings, in which.

DESCRIPTION OF THE PREFERRED EMBODIMENTS

Figure 1:
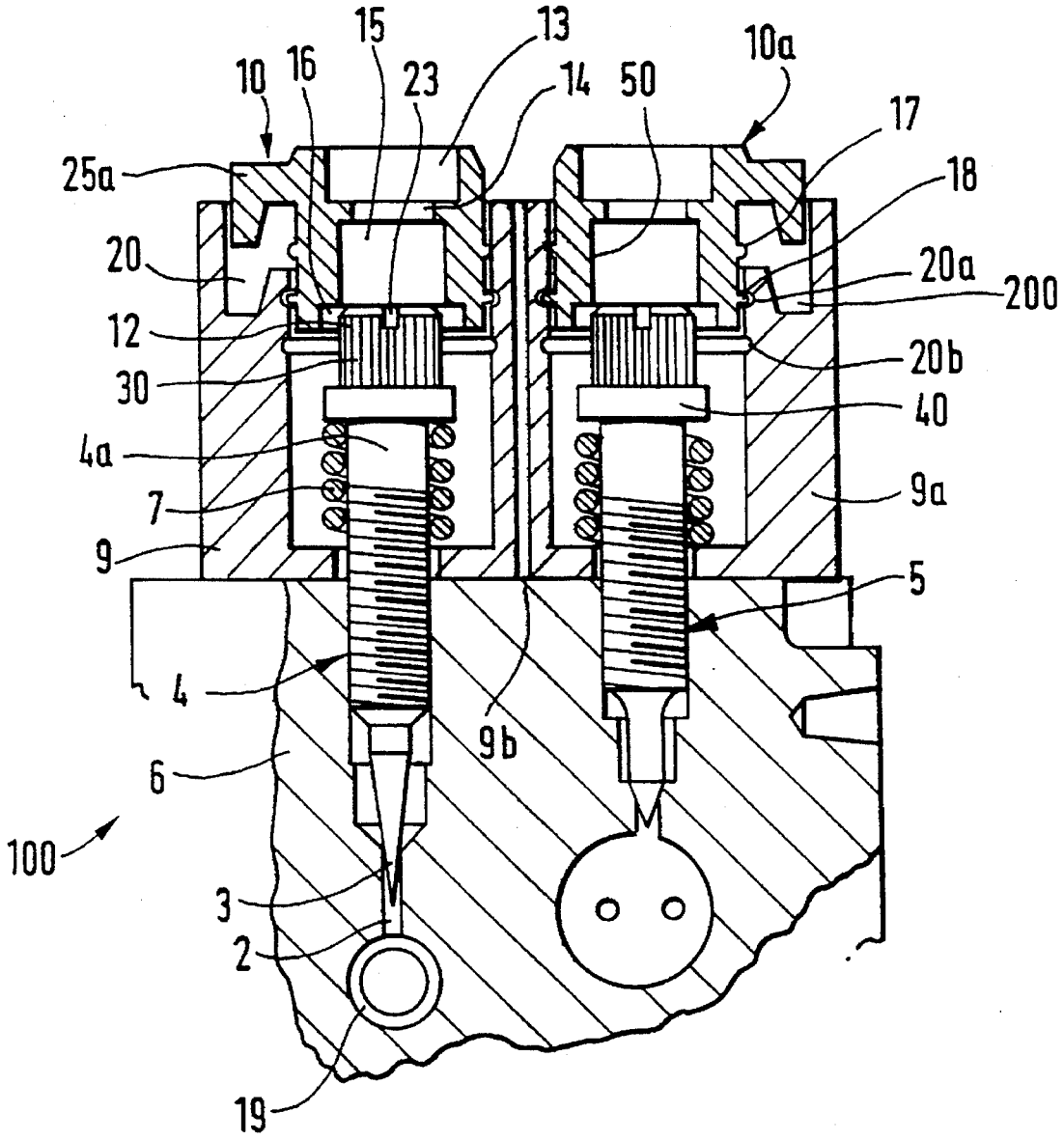
FIG. 1 is a side sectional view of a portion of a carburetor having a pair of adjustment screws according to a first embodiment of the invention in a first position of use.
Figure 2:
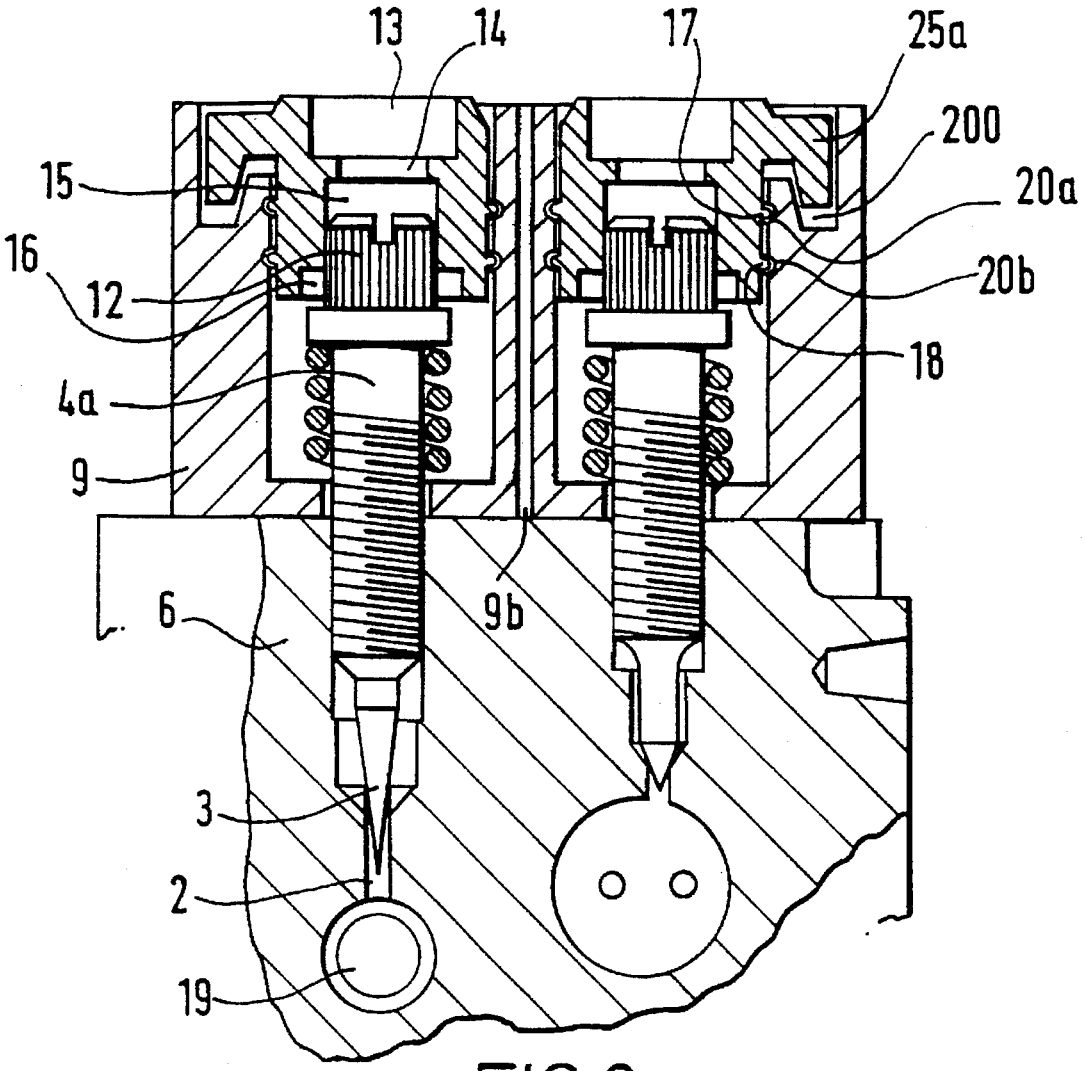
FIG. 2 shows the adjustment screws of FIG. 1 in a second position of use.
Figure 3:
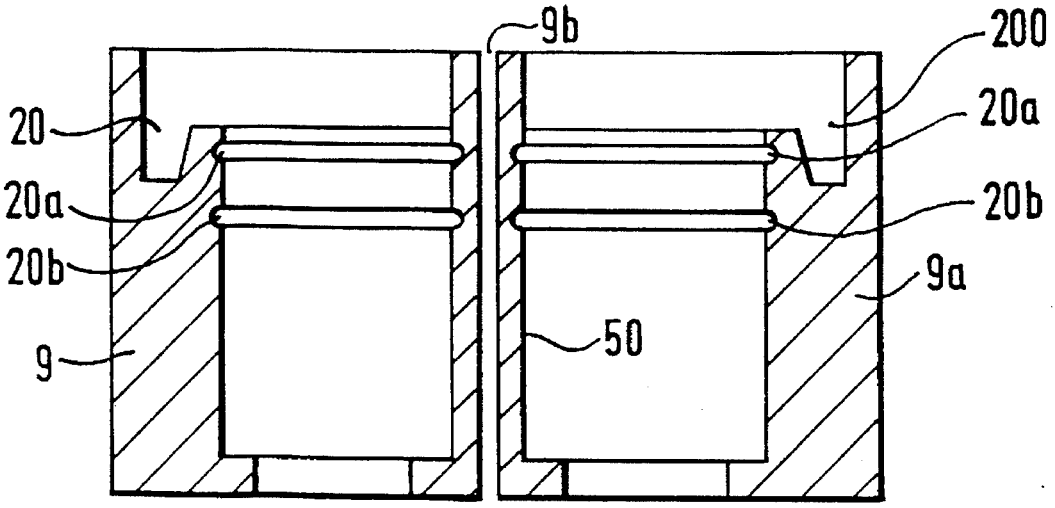
FIG. 3 is a cross-sectional view of the tubular housings of FIG. 1 in the absence of the adjustment screws.

Referring now to the drawings and in particular to FIGS. 1–3, there is shown an assembly 100 according to the invention which comprises a screw member 4 and a cap member 10. The screw member 4 in the present example is a high speed adjusting screw which is in screw-threaded engagement with the body 6 of a diaphragm type carburetor and regulates the flow of fuel in the carburetor. Such screws are well-known and need not be described here in detail. Briefly, however, rotation of the screw member 4 anti-clockwise moves an associated cone 3 out of an orifice 2 of the carburetor 6 thereby increasing the open area between the cone 3 and the orifice 2 allowing for adjustment of fuel flow to a main nozzle 19 of the carburetor body 6 which in turn feeds fuel to an engine on which the carburetor body 6 is mounted.

The screw member 4 has a shaft 4*a*, of which the cone 16 forms the free end, and a head 12 which has a knurled surface 30 for ease of rotation. The head 12 has a screw-driver slot 23.

An adjustment limiting means is provided in the form of an open-ended generally tubular housing or skirt 9 surrounding the head 12 of the screw member 4 and through which the shaft 4*a* passes. A coil spring 7 is held under tension between the base of the housing 9 and a flange 40 formed on the shaft 4*a* below the head 12. The skirt 9 has an arcuate slot or recess 20 therein which is substantially coaxial with the axis of the screw member 4. In addition, the skirt 9 has a pair of axially spaced internal circumferential grooves or recesses 20*a*, 20*b* disposed one above the other in substantially parallel spaced apart relationship (see FIG. 3).

The cap member 10 is mounted in the open end of the housing 9 at the head end of the screw member 4 and is essentially tubular in construction. Internally, the cap 10 has a through bore comprising three sections 14, 15 and 16 each of different diameters. The section of narrowest diameter is section 14, the diameter of which is less than the diameter of the head 12; the section 15 has a diameter slightly smaller than the diameter of the head 12; and the section 16 has a diameter slightly greater than that of the section 15. The internal surface 50 of the section 15 may be knurled. The diameters of the sections 14 and 16 are not critical; the diameter of the section 15 is critical for reasons which will be clearer later in the Specification. Externally, the cap 10 has a pair of substantially parallel axially spaced circumferential projections or ribs 17, 18 which are spaced apart substantially the same as the grooves 20*a*, 20*b*. Projecting radially outwardly from the member 10 is an element 25*a* which extends into the recess 20. An upper section 13 is provided for providing access for a screw driver through the section 14 to the screwdriver slot 23.

The cap member 10 is movable axially of the screw member 4 between a first position of use (FIG. 1) and a second position of use (FIG. 2). In the first position of use, the projection 18 engages in the recess 20*a*, and when thus engaged, the cap member 10 is prevented from falling away from the skirt 9; there is no contact between the cap member 10 and the head 12 and thus the head 12 is freely rotatable in either direction relative to the cap member 10. The screw driver slot 23 is accessible via the slot 13 and sections 14–16. There is a positive snap-to-engage relationship between the projection 18 and the recess 20*a*.

Accordingly, in the case of the present embodiment, the initial factory setting of the adjustment screw member 4 may be made. Having regard to the fact that in a carburetor there is both a high speed adjusting screw and a low speed adjusting screw, the embodiment shown in the drawings depicts, in addition to the high speed adjusting screw member 4, a low speed adjusting screw member 5 which has substantially all the constructional features of the screw member 4 and associated components. The adjustment limiting means is in the form of a skirt 9*a* which has all of the features of the skirt 9 being separated therefrom by a small gap 9*b*. In addition, the cap member 10*a* has all the features of the cap member 10 and functions in a similar manner. The skirt 9*a* has a recess 200 equivalent to the recess 20. Having regard to the fact that the skirts 9,9*a* are separated by the gap 9*b*, it is essential that means be provided to fix each skirt 9,9*a* to the carburetor body 6.

Following the mounting of the carburetor body 6 to a suitable engine and with the members 10,10*a* still in the first position of use, the low speed and/or high speed screw members 4 and 5 are adjusted in a conventional manner by rotation of the relevant head 12. The fact that the skirts 9,9*a* are fixed to the carburetor body 6 prevents rotation of the skirt 9 (or 9*a*) during rotation of the relevant head 12. Following adjustment, each cap 10,10*a* is pushed into the second position of use wherein the projection 25*a* engages in the recess 20 (or 200). In this position the knurled surface 30 of the head 12 engages the (knurled) surface 50 of the cap member 10 (or 10*a*), so that rotation of the head 12 results in rotation of the cap member 10 (or 10*a*). In fact, having regard to the diameter of the section 15, there is an interference fit interengagement between the surface 50 and the surface 30 of the head 12. Furthermore, projection 18 engages in the recess 20*b* and the projection 17 engages in the recess 20*a*. There is now a positive snap-to-engage relationship between the projection 18 and the recess 20*b* and also between the projection 17 and the recess 20*a*. This two-fold snap-to-engage arrangement makes it very difficult for the cap member 10 (or 10*a*) to be removed from the skirt 9 (or 9*a*).

Since the projection 25*a* extends into the arcuate slot 20 in the case of the screw member 4 or the arcuate slot 200 in the case of the screw member 5, the projection 25*a* limits the degree of rotation of the cap 10 and the head 12, because the adjustment which can be made to the screw is limited to the angle subtended by the ends of the slot 20 or 200 at the axis of the relevant screw member. The adjustment made to the screw member 4 or 5 when the cap 10 was in the first position of use together with the length of the slots 20 and 200 enables the manufacturer of the engine to restrict the performance of the engine within specified emission limits. The slot 200 may have the same or a different length to the slot 20.

Thus, there is provided a carburetor in which adjustments may be freely made when the cap 10 (or 10*a*) is in the first positioning of use but, once placed in the second position of use, free adjustment is very difficult without damaging the components of the carburetor.

With reference to FIGS. 4–7, there is shown a similar arrangement to that shown and described with respect to FIGS. 1–3 except that there is provided a single skirt 9*c* thus omitting the gap 9*b*. In addition, because there is provided a single skirt, it is not necessary to fix the skirt to the carburetor body 6 because during rotation of, for example, the head 12 of the screw 4, rotation of the skirt is prevented by the interengagement of the screw 5 and the carburetor body and vice versa.

It will be understood that the skirts 9, 9*a* and 9*c* and the cap member 10 may be made of a plastics material, to allow for the interengagement of the projections 17,18 with the recesses 20*a*, 20*b* as described when moving from the first position to the second position. Suitable plastics materials include those made from polyacetal or glass filled polyamide. Natural rubber or some rubber compounds as is well known would not be suitable in an environment which employs fuels such as petrol.

Figure 8:
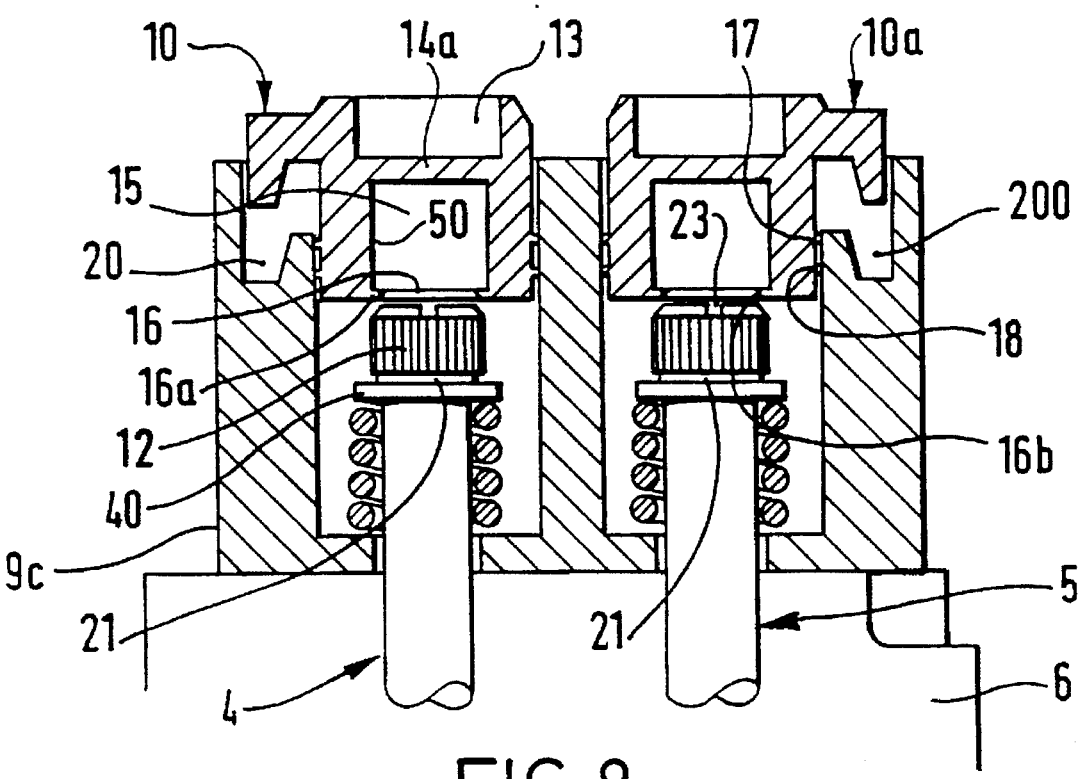
FIG. 8 is a side sectional view of a portion of a carburetor having a pair of adjustment screws according to a third embodiment of the invention in a first position of use.
Figure 9:
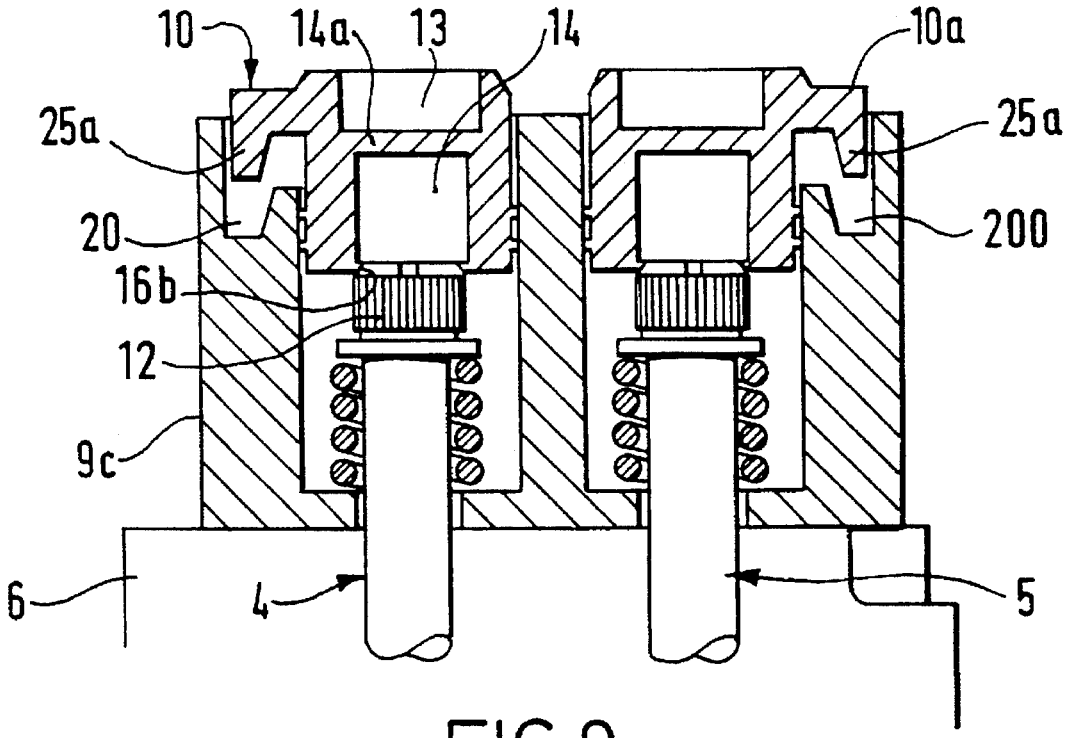
FIG. 9 shows the adjustment screws of FIG. 8 in an intermediate position of use.
Figure 10:
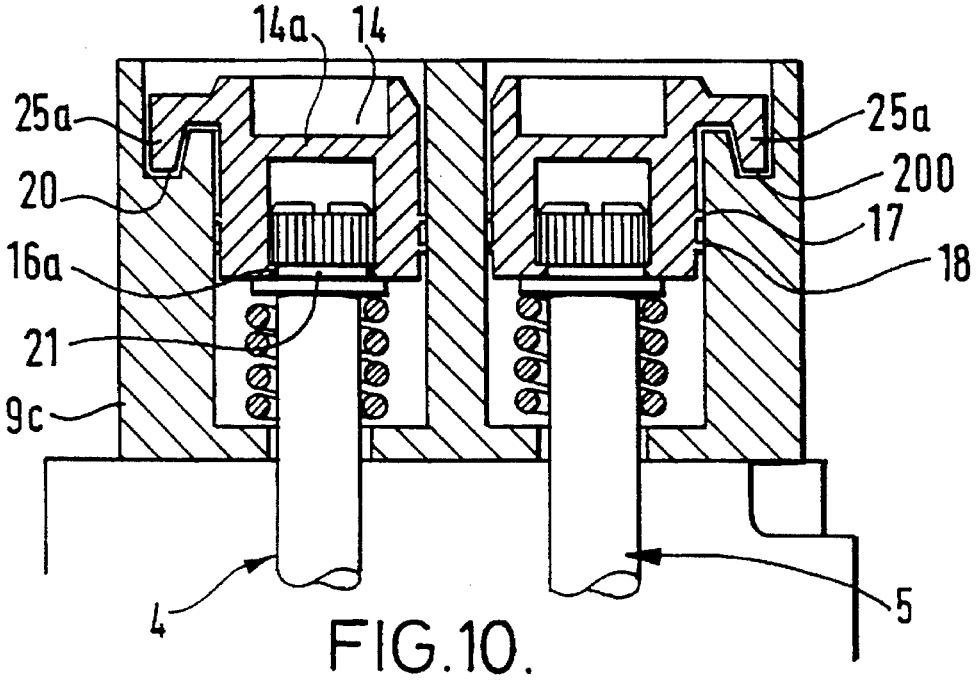
FIG. 10 shows the adjustment screws of FIG. 9 in a second position of use.
Figure 11:
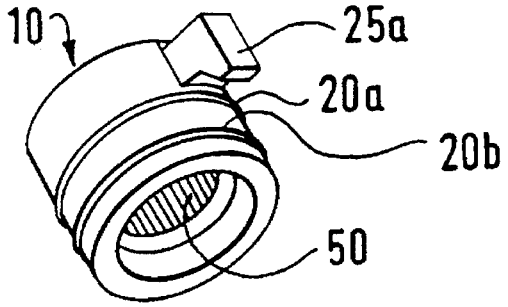
FIG. 11 is an exploded view of an adjustment screw and associated cap for use in the apparatus according to the invention.
Figure 11:
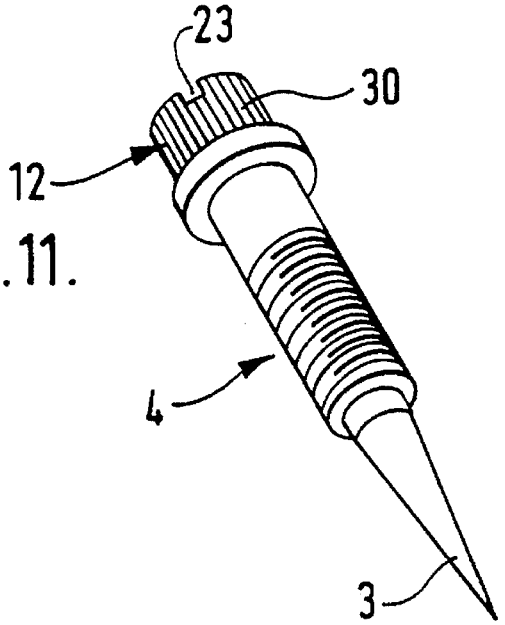

With particular reference to FIGS. 8–10, there is shown a third embodiment of the invention. The components of this embodiment are identical to that described with reference to FIGS. 4–6 of the drawings except as follows.

With respect to the skirt 9*c*, recesses 20*a*,20 are absent. With respect to the cap member 10 (or 10*a*) the projections 17,18 are of considerably reduced size for reasons which will be explained below. In addition the section 14 is absent. In place of the section 14 is a disc member 14*a* contiguous with the cap member 10 (or 10*a*) so as to provide a barrier between the section 13 and the section 15. The section 16 has a diameter slightly less than that of the section 15 by virtue of an inward annular projection 16*a* having a chamfered surface 16*b*. In addition the shaft 4*a* has an annular flange 40 which, together with the head 12 define an annular recess 21. Similarly, the shaft 4*a* of the screw member 5 has a flange 40 which together with the head 12 define an annular recess 21. Otherwise, the components of the embodiment shown in FIGS. 8–10 are identical to that shown and described with reference to FIGS. 4–6 of the drawings. The skirt 9*c* may be made from a plastics material or metal; the cap member 10 (10*a*) is made from a plastics material.

Figure 4:
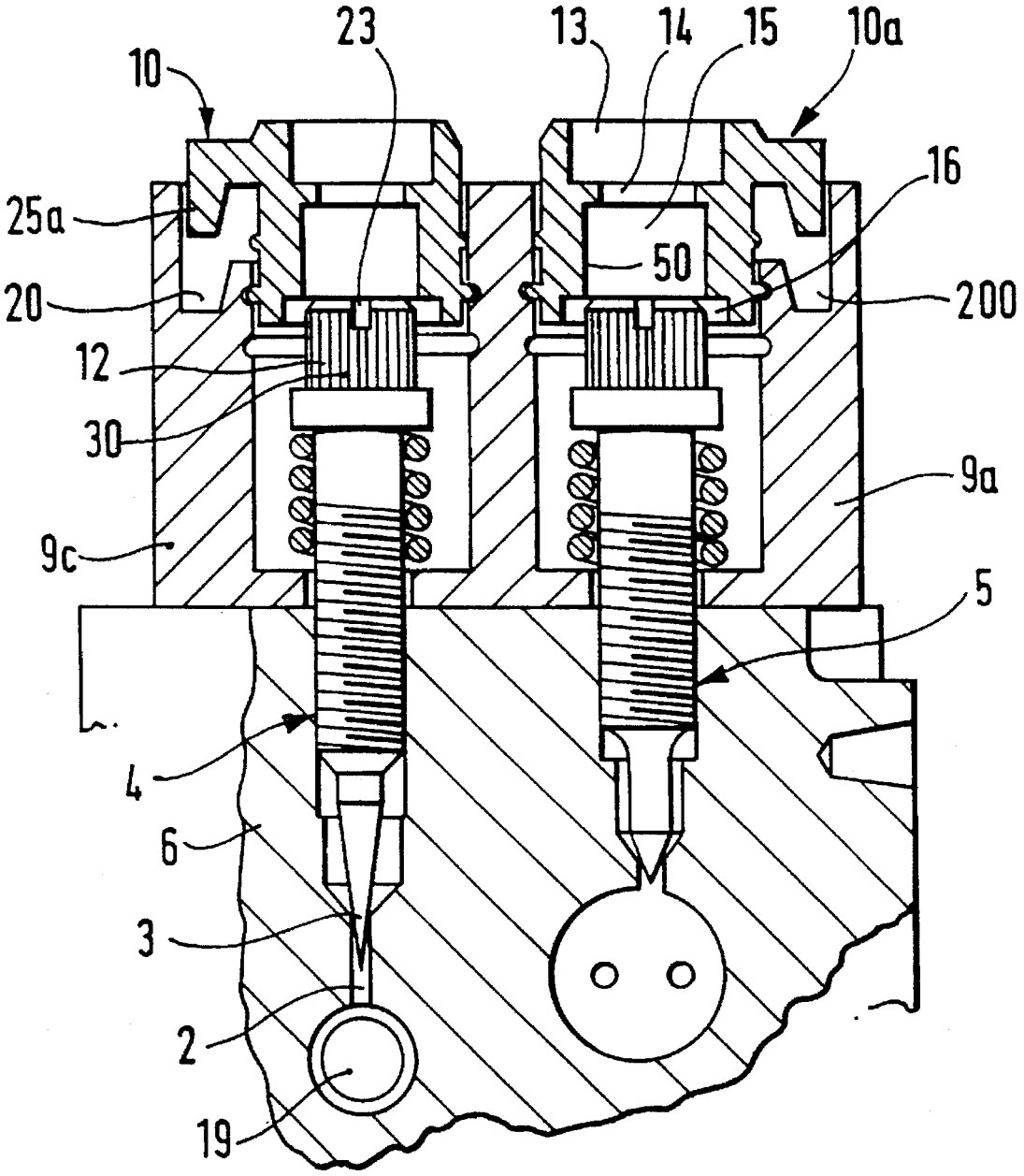
FIG. 4 is a side sectional view of a portion of a carburetor having a pair of adjustment screws according to a second embodiment of the invention in a first position of use.
Figure 5:
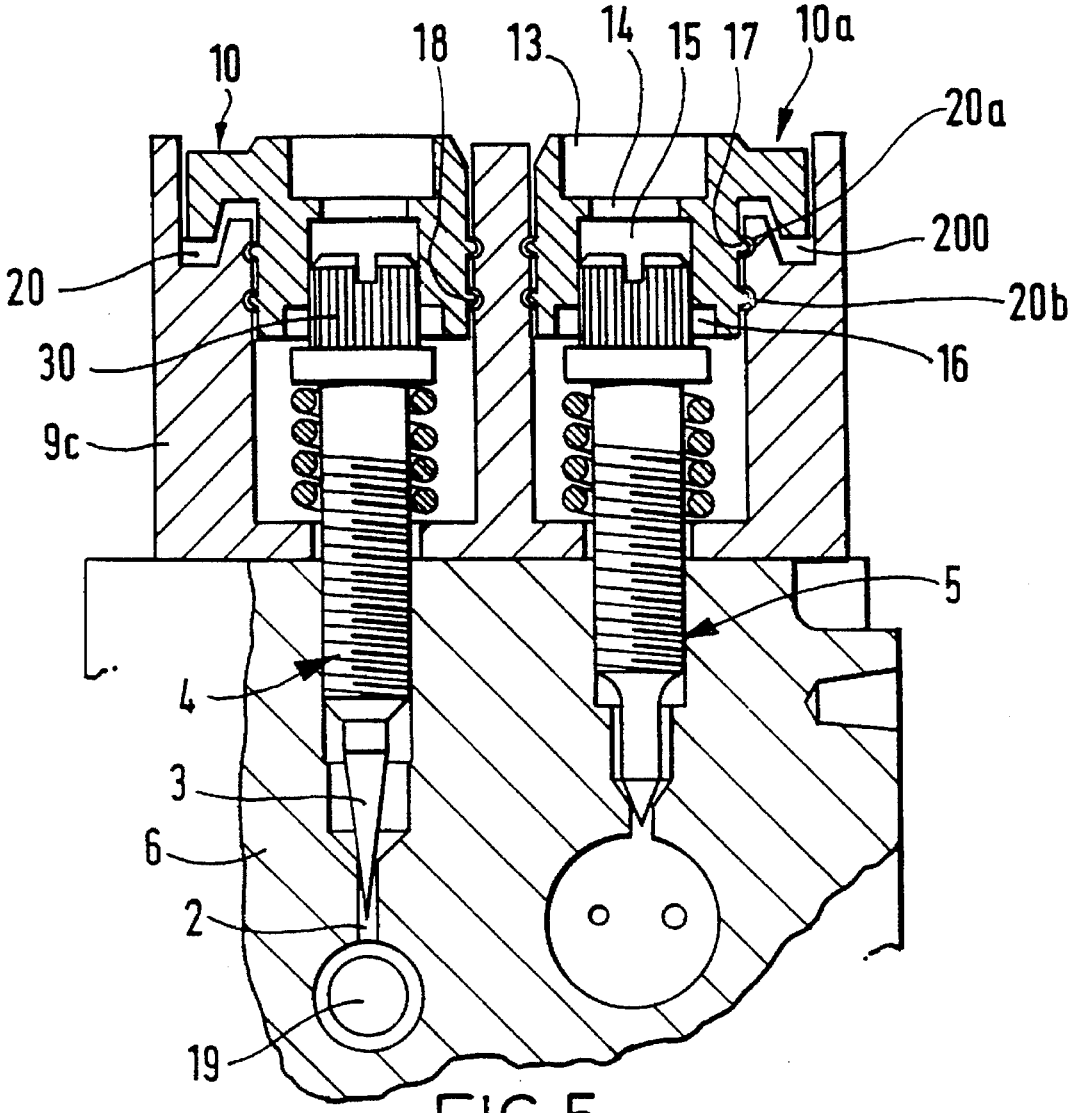
FIG. 5 shows the adjustment screws of FIG. 4 in a second position of use.
Figure 6:
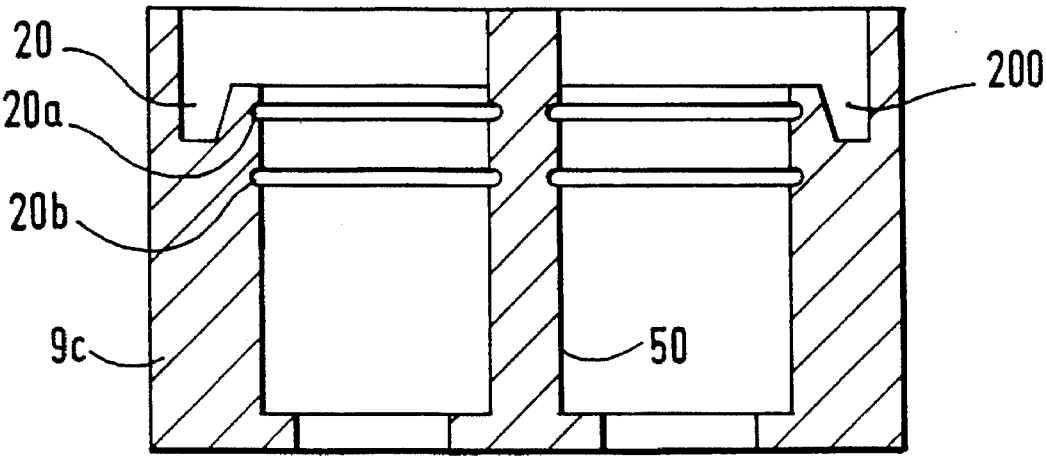
FIG. 6 is a cross-sectional view of the tubular housings of FIG. 4 in the absence of the adjustment screws.
Figure 7:
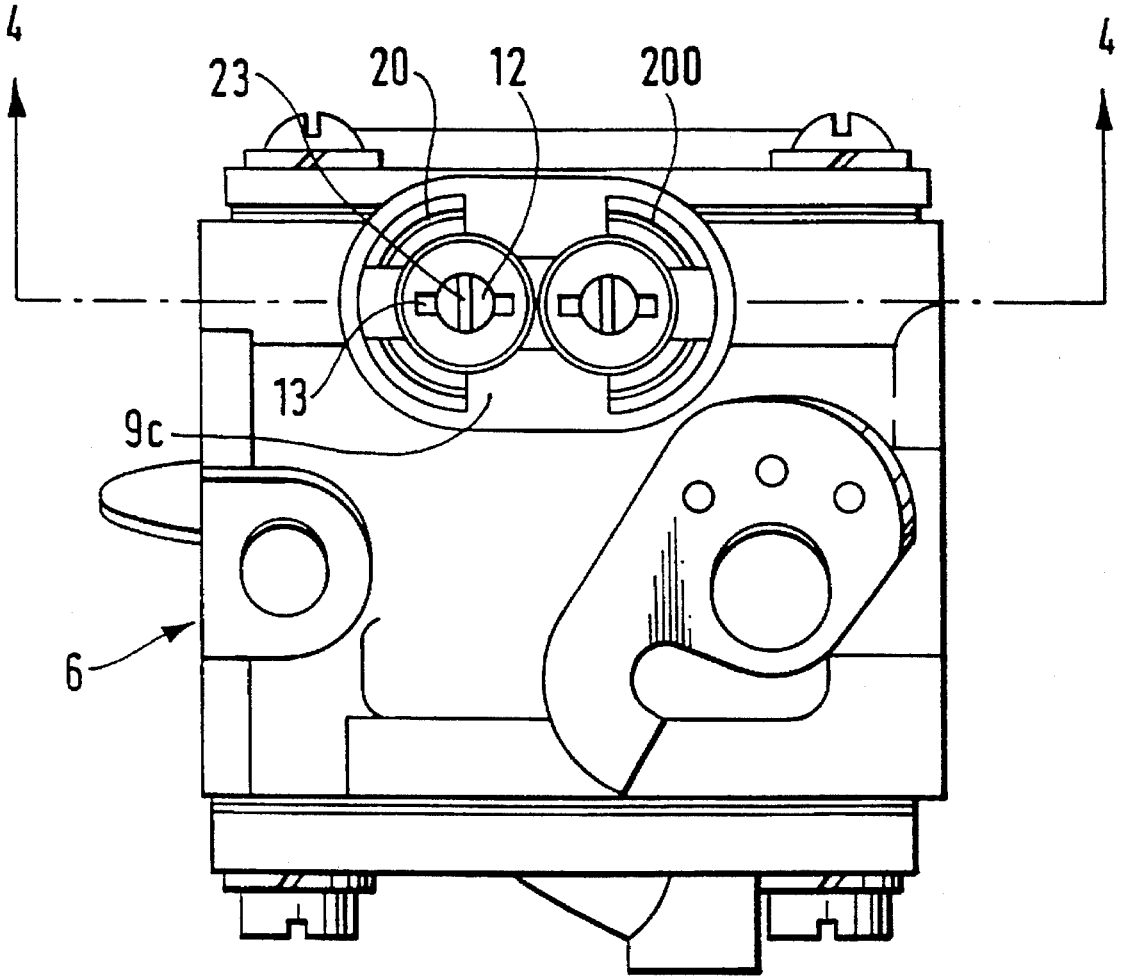
FIG. 7 is a side elevation of a carburetor having a pair of adjustment screws according to FIG. 4 of the drawings, the view shown in FIG. 4 of the drawings being a sectional view taken along the line A—A of FIG. 7.

In use, there is provided a first position of use equivalent to the first position of use of the embodiment shown in FIGS. 4–6 of the drawings. However, although the head 12 is freely rotatable relative to the cap member 10 (or 10*a*), access to the slot 23 is not possible due to the presence of the disc member 14*a*. Accordingly, an intermediate position is provided and shown in FIG. 9 of the drawing in which the chamfered surface 16*b* is in engagement with the head 12 so that the adjustment screw 4 (or 5) may be freely rotated by rotation of the cap member 10 (or 10*a*). Free rotation is possible due to the fact that in said intermediate position of use, the element 25*a* does not engage in the recess 200. In addition, the absence of the snap-to-engage feature described in the first and second embodiments is desirable to enable the cap member 10 (10*a*) to be rotatable relative to the skirt 9*c*. The snap-to-engage feature is absent due to the absence of the recesses 20,20*a* and the reduction in size of the projections 17,18 which projections now provide an interference fit relative to the surface 50.

Following adjustment of the screw 4 (or 5) the cap member 10 (or 10*a*) may be returned to the first position of use (FIG. 8) or placed in the second position of use (FIG. 10). When placed in the second position of use, the projection 16*a* interengages in the recess 21 thus preventing the cap member 10 (or 10*a*) from being returned to the intermediate (FIG. 9) or first (FIG. 8) positions of use or indeed removed from the skirt 9*c*. When in the second position of use, the projection 25*a* engages in the recess 20 (or 200) as previously described. In addition, due to the presence of the disc member 14*a*, it is not possible to access the head 12. The projections 17,18 provide a friction engaging surface with the skirt 9*c* so that when in the first or intermediate positions of use, the cap member 10 (or 10*a*) is held captive in the skirt 9*c*.

Thus, the disc 14*a* makes it considerably more difficult to tamper with a previously set carburetor setting (with the cap members 10, 10*a* in the second position of use).

The invention is not limited by or to the specific embodiment described which can undergo considerable variation without departing from the scope of the invention.

We claim:

1. A carburetor adjustment screw apparatus comprising a screw member having a shaft and a head by which the shaft may be rotated, a generally tubular open-ended housing surrounding the head of the screw member, and a cap member mounted in and supported by the open end of the housing and movable axially of the screw member between first and second positions, the cap member being held by the housing clear of the head of the screw member in the first position and engaging over the head of the screw member in the second position for rotation with the head, the housing having stop means engageable by the cap member in the second position for limiting the angle of rotation of the head.

2. A carburetor adjustment screw apparatus according to claim 1, wherein the stop means comprises an arcuate recess in the housing substantially coaxial with the axis of the screw member, and wherein the cap member has an element which projects into said recess when the cap member is in the second position, the ends of the recess defining the angle of rotation of the head.

3. A carburetor adjustment screw apparatus according to claim 1, wherein the cap member has an opening permitting the head of the screw member to be accessed by a screwdriver for rotation of the head in both the first and second positions of the cap member.

4. A carburetor adjustment screw apparatus according to claim 3, wherein the housing has a pair of axially spaced internal circumferential grooves and the cap member has a pair of similarly axially spaced external circumferential ribs, one of said ribs engaging in one of said grooves in the first position of the cap member and each of said ribs engaging in a respective one of said grooves in the second position of the cap member.

5. A carburetor adjustment screw apparatus according to claim 1, wherein the cap member is constructed to block access to the head of the screw member and wherein the cap member has a further axial position intermediate the first and second positions in which the cap member engages the head of the screw member such that the screw member can be rotated by rotation of the cap member, the stop means not being engaged by the cap member in the intermediate position.

6. A carburetor adjustment screw apparatus according to claim 5, wherein the screw member has an annular recess and the cap member has an inward annular projection, the annular recess being engageable by the annular projection in the second position of the cap member.

* * * * *